US006166339A

United States Patent [19]

Bechis

[11] Patent Number: 6,166,339

[45] Date of Patent: Dec. 26, 2000

[54] SAFETY SWITCH INTENDED TO BE FITTED IN AN ELECTRICAL CIRCUIT OF A MOTOR VEHICLE

[75] Inventor: Giovanni Bechis, Givoletto, Italy

[73] Assignee: Kostal Italia S.r.L., Caselette, Italy

[21] Appl. No.: 09/414,641

[22] Filed: Oct. 8, 1999

[51] Int. Cl.[7] ..... H01H 35/02

[52] U.S. Cl. ..... 200/61.45 R; 200/61.53

[58] Field of Search ..... 200/61.5, 61.48, 200/61.45 R, 61.53

[56] References Cited

U.S. PATENT DOCUMENTS

| | | | |
|---|---|---|---|
| 3,639,710 | 2/1972 | Haruna et al. | 200/61.48 |
| 4,293,751 | 10/1981 | Van Benthuysen et al. | 200/156 |
| 4,467,160 | 8/1984 | Murmann et al. | 200/159 A |
| 4,891,476 | 1/1990 | Nation et al. | 200/11 R |
| 4,939,328 | 7/1990 | Smith | 200/526 |
| 4,968,860 | 11/1990 | Shinohara et al. | 200/314 |
| 5,049,709 | 9/1991 | Prickett et al. | 200/527 |
| 5,145,059 | 9/1992 | Park | 200/527 |
| 5,165,530 | 11/1992 | Shinohara et al. | 200/314 |
| 5,186,316 | 2/1993 | Mortun et al. | 200/527 |
| 5,226,529 | 7/1993 | Valenzona | 200/529 |
| 5,424,502 | 6/1995 | Williams | 200/85 A |
| 5,917,162 | 6/1999 | Jackman | 200/61.45 R |

FOREIGN PATENT DOCUMENTS 0644568 3/1995 European Pat. Off. .

*Primary Examiner*—Michael L. Gellner
*Assistant Examiner*—Nhung Nguyen
*Attorney, Agent, or Firm*—Sughrue, Mion, Zinn, Macpeak & Seas, PLLC

[57] ABSTRACT

The safety switch incorporates a substantially cylindrical inertial mass which is horizontally movable in all directions in a cavity of the-body of the switch. The inertial mass has a peripheral edge which is engageable with a cam action by projections of a resetting push button for returning it to a centered position. A base surface of the inertial mass has a central depression for housing the upper end of a push rod and maintaining the push rod in a position corresponding to a first state of the circuit. This base surface also has a concentric annular groove into which, when the inertial mass is in an eccentric position, the push rod enters causing the movable contact member to move to a position corresponding to a second state of the circuit. The switch also includes means for disengaging the push rod from the annular groove under the action of the resetting push button, in order to enable the inertial mass to return to the centered position. The arrangement is such as to make sure that when the resetting push button is pressed, the inertial mass cannot slide away by accident from the centered position to the eccentric position, even if the vehicle is not level.

4 Claims, 5 Drawing Sheets

FIG. 1
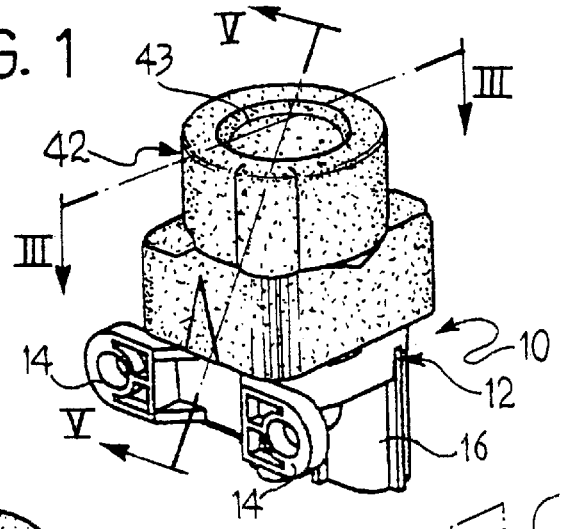
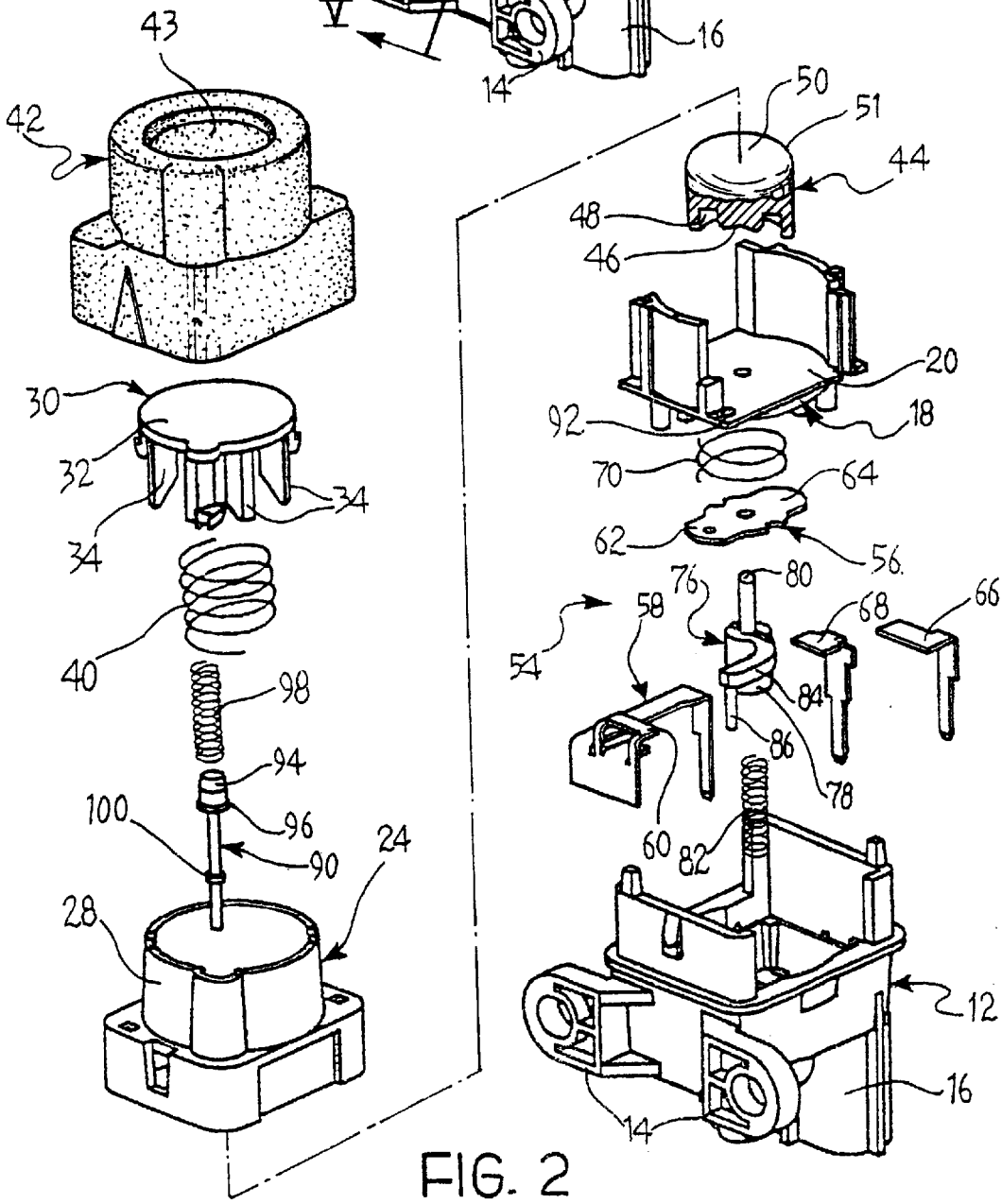
FIG. 2

SAFETY SWITCH INTENDED TO BE FITTED IN AN ELECTRICAL CIRCUIT OF A MOTOR VEHICLE

DESCRIPTION

The present invention relates to a safety switch intended to be fitted in an electrical circuit of a motor vehicle, of the type comprising:

- a hollow body for fixing to the motor vehicle and having a cavity with a transverse base wall and a transverse covering wall;
- an inertial mass in the form of a body of revolution capable of moving radially between the base wall and the covering wall, between a centred position and an infinite number of eccentric positions;
- a system of electrical contacts situated to a side of the base wall remote from the cavity and comprising a movable contact member capable of establishing first and second circuit states of the switch;
- a push rod associated with the movable contact member and extending centrally through the base wall to engage the inertial mass;
- opposing resilient means which tend to urge the movable contact member and the push rod to the position corresponding to the second state of the circuit;
- the arrangement being such that when the inertial mass is in the centred position, it retains the push rod held against the force of its opposing resilient means and enables the movable contact member to stay in the first state of the circuit, while when the inertial mass has moved to an eccentric position, the push rod is free to move under the force of its resilient opposing means, moving the movable contact member to the position corresponding to the second state; and
- a reset push button accessible from the outside of the switch, which faces the covering wall outside the cavity, and which comprises a plurality of projections extending towards the base wall through the covering wall and having inclined active surfaces inclined towards the base wall; and
- resilient biasing means which urge the reset push button to a rest position in which it is remote from the covering wall;
- the arrangement being such that when the push button is in the rest position, its projections do not engage the inertial mass, while when the inertial mass is in an eccentric position and the push button is pressed against the force of its resilient biasing means, the projections engage the inertial mass with a cam action and move it to the centred position.

The invention was conceived in terms of its application to a safety switch intended, in the event of a collision, to break the electrical supply circuit to an electric pump for the supply of fuel to the engine of a motor vehicle, but is not limited to this application.

A safety switch of the above-said type is known from document EP-A-0 644 568.

In this known switch, the inertial mass is constituted by a metal sphere. The wall covering the cavity has a central circular seat in the form of a hole. When the sphere is in the central position, the elastic thrust of the push rod keeps a small part in the form of a crown of the sphere engaged in the seat. The diameter of the hole and the crown must be fairly small with respect to the maximum diameter of the sphere in order to enable this latter to disengage from the seat in the event of a collision of predetermined force.

Notwithstanding its engagement in the seat of the covering wall, the sphere in the centred position is in relatively unstable equilibrium in that it is engaged by the push rod with substantially point contact in the position opposite the seat in the covering wall.

It has been shown in practice that this unstable equilibrium means that the sphere frequently moves from its centred position with the consequent release of the switch, even when the motor vehicle experiences a very light collision that does not justify breaking the electrical supply to the electric pump, or even if the driver stops very sharply.

It has also been shown that due to continuous vibrations the sphere erodes the push rod to such an extent that the operation of the device is jeopardised.

On the other hand, when the sphere is in one of the eccentric positions after the release of the switch, it is not held positively in this position. It is therefore possible that if the motor vehicle experiences a second collision following the first collision, the sphere may return spontaneously to the centred position, thus reinstating the circuit, which is completely unacceptable.

The primary object of the invention is to provide a safety switch which, although having the required sensitivity to collisions, will not be likely to experience unnecessary snap changes in the sense of both the interruption and the restoration of the electrical supply to the electric pump, but also, in order to allow the vehicle to be restarted, will ensure that the switch remains closed after the push button has been pressed, irrespective of the inclination of the vehicle.

Another object of the invention is that to avoid the aforesaid drawback of erosion of the push rod by the eccentric mass through the effect of vibrations.

According to the invention, these objects are achieved by a safety switch wherein:

- the inertial mass is in the form of a body of revolution about an axis at right angles to the base wall and the covering wall, and has a flat base surface engaged with the aforesaid base wall and a flat head surface having a peripheral edge which is engageable with a cam action by the projections of the push button,
- the base surface has a central depression shaped substantially as a flattened cone for housing the push rod and for maintaining the push rod in the position corresponding to the first state of the circuit, and an annular groove concentric with the depression into which, when the inertial mass is in an eccentric position, the push rod enters to reach a position corresponding to the second state of the circuit, the central depression and the annular groove being separated from each other by a crest;
- the annular groove is bounded by a radially inner annular side which has an annular bevel adjacent to the said annular crest to constitute a ramp adapted to cooperate in the manner of a cam with an end of the push rod against the force of its opposing resilient means to repel the push rod to a position such as to allow the annular crest to pass beyond said push rod when the mass is being brought back to the central position and to allow the push rod to enter the central depression; and
- disengagement means are provided, which interconnect the push button and the push rod in an arrangement such that, when the internal mass is in an eccentric position with the end of the push rod inserted in the annular groove, a pressure on the push button moves, in a first time, the push rod to a partially withdrawn position in which, when the projections of the push button engage the inertial mass to move the latter to the centered position, the said annular bevel repels the push rod, in a second time, allowing the annular crest to pass beyond the latter.

In a safety switch according to the invention, holding the inertial mass firmly in the centred position is ensured by the fact that in this condition the push rod is engaged in the central depression of the mass. Furthermore, holding the inertial mass stably in the eccentric position is guaranteed by the positive engagement of the push rod in the annular groove.

Erosion of the push rod through the effect of vibration can no longer take place thanks to the fact that the end of the push rod is normally inserted in the central depression and prevents lateral vibrations of the inertial mass.

A further advantage of the invention lies in the fact that during development, the profiles of the central depression and the annular groove of the inertial mass can be designed so as to calibrate the sensitivity of the switch for each specific use. Such calibration was practically impossible to obtain with a spherical inertial mass.

Thanks to the arrangement, which includes, among the other things, on the one hand, the annular bevel on the crest which separates the central depression from the annular groove, and on the other hand the thrust means which interconnect the push button and the push rod, one obtains the guarantee that the inertial mass remains in the centered position when it has been positively brought to that position when the push button has been pressed, and this irrespective of the inclination of vehicle.

In the present description, it is emphasised that for electrical reasons, certain parts described and illustrated are understood as being made from insulating material and certain others from electrically conductive material, even in the absence of specific indications of their nature.

The invention will be more clearly understood from the following detailed description, given by way of non-limitative example, with reference to the accompanying drawings in which:

FIG. 1 is a perspective view of a safety switch incorporating the characteristics of the invention;

FIG. 2 is an exploded perspective view of the switch of FIG. 1;

Figure 4:
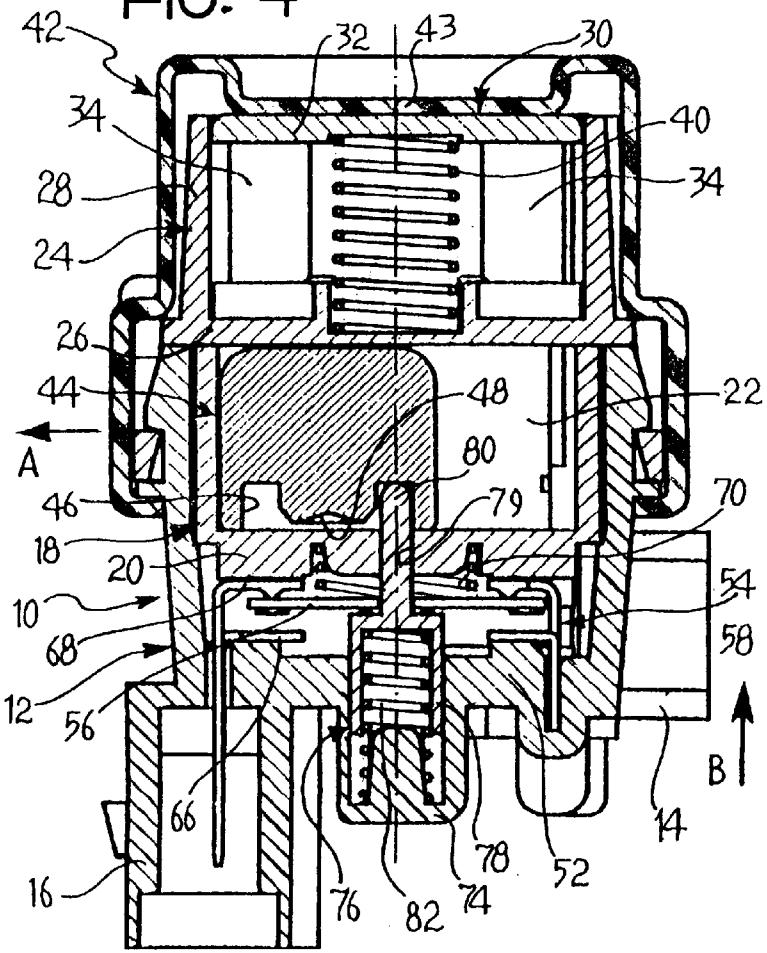
FIGS. 3 and 4 are sections on an enlarged scale in the diametral plane indicated III—III in FIG. 1, showing the switch in first and second states of the circuit, respectively.

With reference to FIGS. 1 to 9, a safety switch comprises a hollow body generally indicated 10 in FIGS. 1 and 3 to 9.

The body 10 comprises a base part 12 with which are integrally formed fixing lugs 14 and a tubular projection 16 housing the pins of a connector for connection to an external electric circuit.

The lugs 14 are intended to the fixing of the switch to a wall of a motor vehicle so that the general axis of the switch is vertical and its inertial mass, about which more will be said below, is displaceable horizontally in all directions.

An insert 18 defining a transverse base wall 20 of a cavity indicated 22 in FIGS. 3 to 9, forms part of the body 10.

A cover 24 snap-engaged with the base portion 12 and holding the insert 18 captive also forms part of the body 10. The cover 24 defines a transverse wall 26 for covering the cavity 22.

On its side remote from the cavity 22, the cover 24 has a bushing-like portion 28.

A reset push button 30, slidable along the axis of the switch, is mounted within the bushing-like portion 28.

The push button 30 comprises an upper disc portion 32 and a plurality of rigid strip-like projections 34 (four positioned at 90° with respect to each other in the embodiment shown).

For reasons that will become clear below, the projections 34 are able to penetrate the cavity 22 through respective slits 36 (FIGS. 5 to 9) in the transverse covering wall 26.

Each projection 34 has an inclined active surface 38 (FIGS. 5 to 9), the function of which will become clear below.

Figure 3:
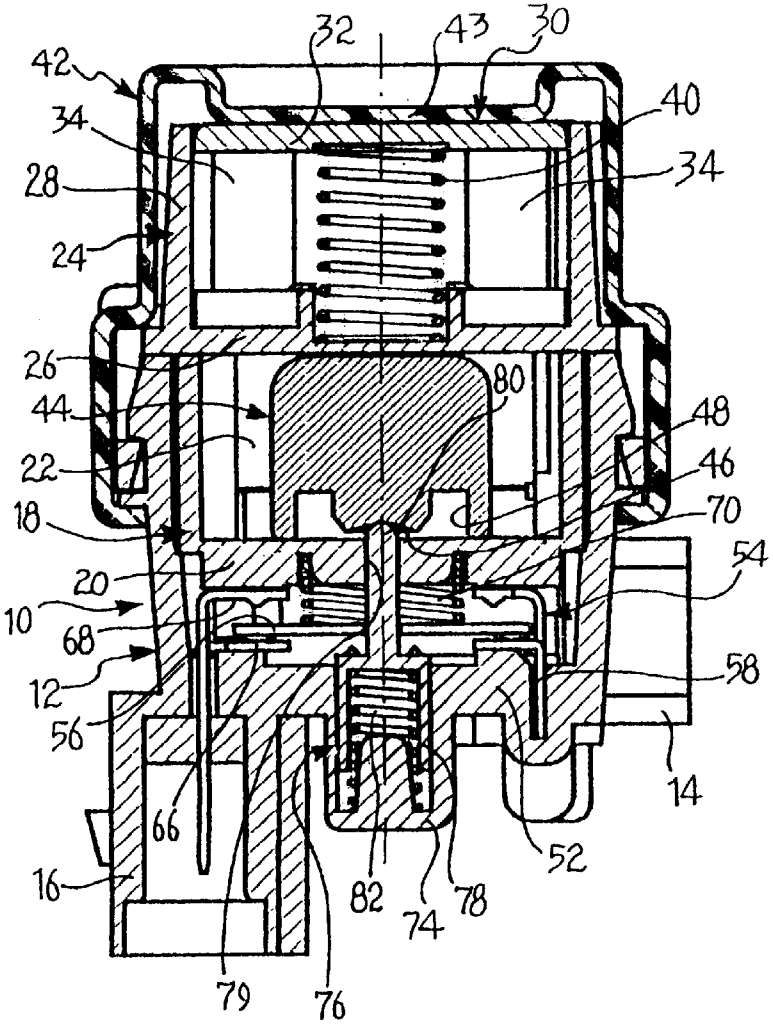
Figure 5:
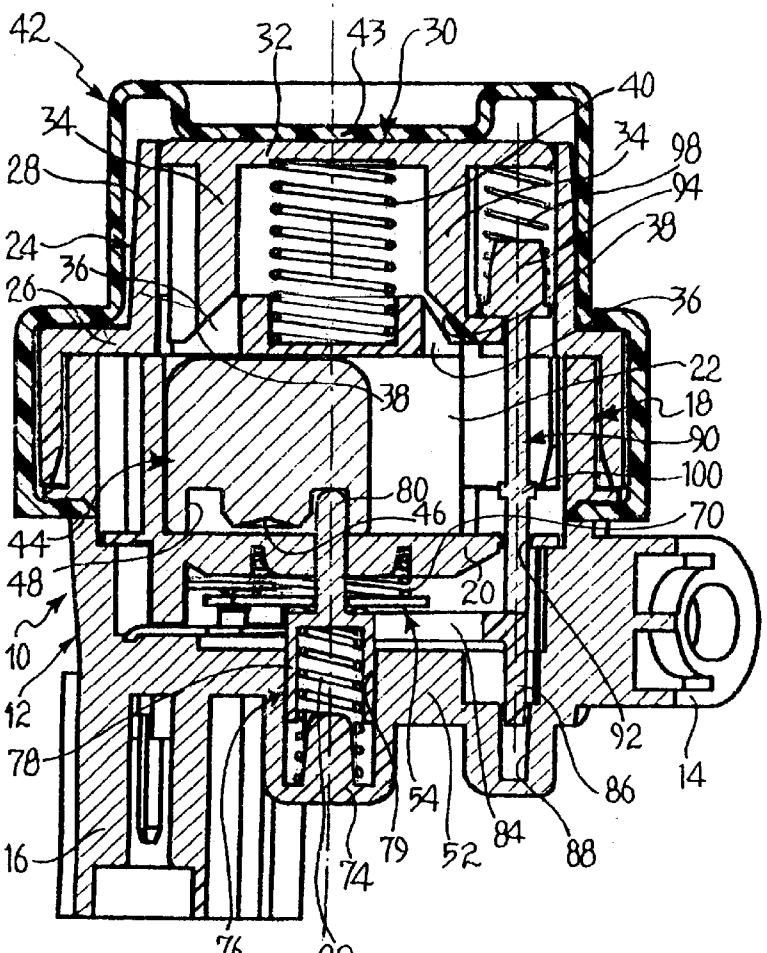

Between the disc portion 32 of the push button 30 and the covering wall 26 are interposed opposing resilient means in the form of a compression coil spring 40 which tends to hold the push button 30 in the rest position of FIGS. 3 to 5.

Around the base portion 12 and the cover 24 is fitted a shaped hood 42 made from rubber or a similar flexible material, which hood keeps the interior of the switch watertight. The hood 42 comprises among other things a deformable upper wall 43 through which it is possible to act on the disc 32 to press the push button 30 against the force of the opposing spring 40 when, as will become clear below, the normal circuit state of the switch is restored.

An inertial mass 44 made from a relatively heavy material is contained in the cavity 22.

In a preferred embodiment, the mass 44 may be of turned brass with a surface nickel plating.

The inertial mass 44 is guided by the base wall 20 and the covering wall 26 in such a way that it can move horizontally (in the installed condition) in all directions.

The inertial mass 44 is shaped as a body of revolution which is substantially cylindrical about an axis which is perpendicular to the base wall 20 and the covering wall 26.

Figure 10:
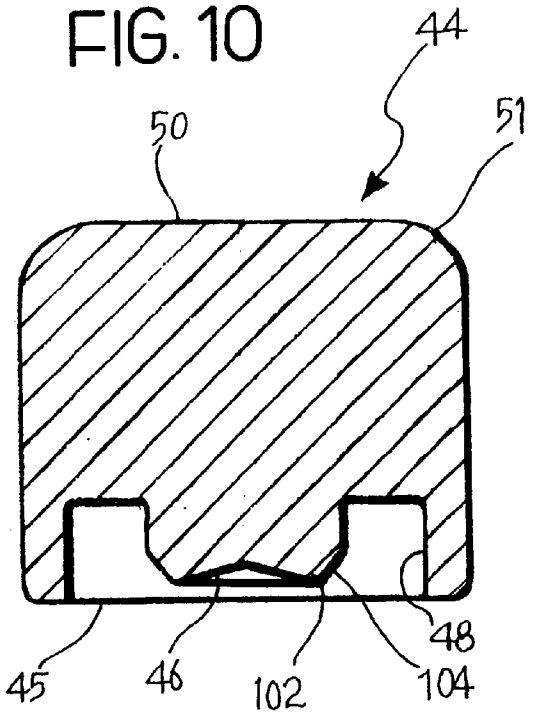
FIG. 10 is a diametral section in an enlarged scale of the inertial mass shown in FIGS. 2 to 9.

With particular reference to FIG. 10, a base surface 45 of the mass 44, which is slidingly engaged with base wall 20, has a central depression 46 and an annular groove 48 concentric with the depression.

The flatness and the parallelism of the planar base surface 45 and the head surface 50, which are relatively large, allows to avoid stuttering of the inertial mass 44 between the base wall 20 and the covering wall 26.

For the purposes which will become clear below, the central depression 46 has a substantially conical, flattened shape and the groove 48 has a depth which is greater than that of the depression 46.

Further details of the inertial mass 44 will be described below with reference to FIG. 10.

The inertial mass 44 further has a flat head surface 50 with a rounded peripheral edge 51 (FIG. 10) which, as will better be seen below, is intended to be engaged by the inclined active surfaces 38 of the projections 34 of the push button 30.

The head surface 50 slidingly engages the covering wall 26 of the cavity 22.

The reference numeral 52 designates a lower wall of the base portion 12 of the body 10.

A system of electrical contacts, generally indicated 54 in FIGS. 2 to 9, is disposed between this lower wall 52 and the base wall 20 of the cavity 22.

The system of contacts 54 includes a movable contact 56 in the form of a plate which extends diametrically across the body 10.

The system of contacts 54 further includes (FIGS. 2 to 4) a first fixed contact 58 in the form of a shaped strip which has (FIG. 2) a loop 60 in which a first end 62 of the plate 56 is movably retained.

The other end 64 of the plate 56 is adapted to cooperate at its front, either with a second fixed contact blade 66 or alternatively with a third fixed contact blade 68.

Biasing means in the form of a compression coil spring 70 are interposed between the base wall 20 and the plate 56 in order to maintain this latter in a first circuit state in which it connects the first fixed contact 58 with the second fixed contact 66.

When the switch is used as a safety switch in a motor vehicle, this first state of the circuit corresponds, for example, to the closure of the electrical supply circuit to a fuel pump.

Referring to FIGS. 2 to 9, the lower wall 52 of the lower body 12 has a hollow central boss 74 in which a push rod generally indicated 76 is slidingly mounted along the axis of the switch.

The push rod 76 comprises a lower tubular section 78 slidingly mounted like a piston in a cylindrical cavity of the boss 74, and an upper section in the form of a rod which extends upwards through a corresponding hole 79 in the base wall 20, a rounded upper end 80 of which engages the base surface of the inertial mass 44, in particular, and depending on the conditions, its central depression 46 or its annular groove 48.

The push rod 76 is biased in engagement with the base surface 45 (FIG. 10) of the inertial mass 44 by opposing resilient means in the form of a compression coil spring 82 contained in the cavity of the tubular part 78 of the push rod 76.

A lateral projection 84 (FIGS. 2 and 5 to 9) in the form of a rigid blade having a square shape in plan and which reaches a peripheral zone of the base portion 12 of the body 10 is fixed to the push rod 76.

A zone adjacent the free end of the projection 84 has a guide pin 86 fixed thereto, which is slidable in a blind hole 88 of the lower wall 52 of the base portion 12.

In FIG. 3, the switch is shown in the condition corresponding to the first state of the circuit in which the inertial mass 44 is centred on the axis and the rounded upper end 80 of the push rod 76 is engaged in the depression 46 due to the force of the opposing spring 82.

In its application to a motor vehicle, when the motor vehicle experiences a jolt from any direction greater than a predetermined acceleration threshold, for example, of the order of 10 to 14 g, the opposing spring 82 is so calibrated and the conical profile of the central depression 46 is so designed that (FIG. 4), due to a cam effect, the inertial mass 44 is able to move in the direction corresponding to the jolt (arrow A) and the push rod 76 moves back against the force of its opposing spring 82, and then snaps upwards with its upper part 80 becoming inserted into the peripheral annular groove 48.

When rising upwards, as shown by the arrow B in FIG. 4, a shoulder surface of the push rod 76, constituted by the upper face of the projection 84, carries with it the movable contact plate 56 which, while remaining electrically connected to the first fixed contact 58, moves away from the second fixed contact 66 and contacts the third fixed contact 68.

This condition, called the second state of the circuit, can be used, for example, to close an auxiliary electrical circuit for signalling the disconnection of the electric pump, for example, by lighting up a warning light on the dashboard of the motor vehicle.

In many cases, especially in the application to a supply circuit for a fuel pump in a motor vehicle, if the motor vehicle has not suffered severe damage following the impact and is able to move using its own engine, it is desirable that the switch is restored to the first state of the circuit in which the electrical continuity between the first contact 58 and the second contact 66 is established.

The push button 30 is provided for this purpose.

By exerting a pressure on the push button 30 against the force of its opposing spring 40, the projections 34 descend into the cavity 22 and their inclined surfaces 38 engage the peripheral edge 51 of the inertial mass 44 (FIG. 6), tending to bring this latter into the centred position of FIG. 3.

However, this return of the mass 44 to the centred position would be impossible due to the fact that the upper part 80 of the push rod 76 is inserted in the annular groove 48, as in FIGS. 4 and 5.

In order to enable the restoration of the first state of the circuit of FIG. 3, thus enabling the vehicle to move under its own power, specific means are provided for the deliberate disengagement of the upper end of the push rod 76 from the annular groove 48.

A preferred embodiment of these disengagement means is illustrated in FIGS. 2 and 5 to 9.

The disengagement means are in the form of thrust means interconnecting the push button 30 and the push rod 76.

These thrust means comprise at least one thrust stem 90 which extends parallel to the axis of the switch and outside the cavity 22 so that it does not interfere with the movements of the inertial mass 44.

The thrust stem 90 is preferably a turned steel piece.

A lower end of the stem 90 extends through a hole 92 in the base wall 20 and is adapted to thrust-engage an end region of the projection 84, in alignment with the guide pin 86.

The stem 90 is provided with a head 94 at its upper end, with a base peripheral shoulder 96.

A compression coil spring 98, which surrounds the head 94, is interposed between the shoulder 96 and the disc portion 32 of the push button 30.

The stem 90 has a peripheral shoulder collar 100 which is adapted to come into abutment on the base wall 20 to constitute an end stop for the stem 90.

According to the invention, the push button 30 and the push rod 76 could be interconnected by several thrust members having the same overall function as the thrust stem 90.

In FIG. 10 reference 102 indicates an annular crest which separates the central depression 46 from the annular groove 48 of the inertial mass 44.

The crest 102 is preferably at a distance from the general plane of the flat base surface 45 of the inertial 44 in order to reduce the friction surface which hinders the horizontal sliding of said mass.

The annular groove 48, in its bottom region, has a profile with parallel sides to prevent the inertial mass 44 from accidentally returning to the centred position of FIG. 3.

The radially inner annular side of the groove 48 has an annular bevel 104 which is adjacent to the crest 102.

The function of the bevel 104 will be clarified below.

The restoration of the safety switch to the first state of the circuit illustrated in FIG. 3 occurs in the sequence illustrated in FIGS. 6 to 9.

Figure 6:
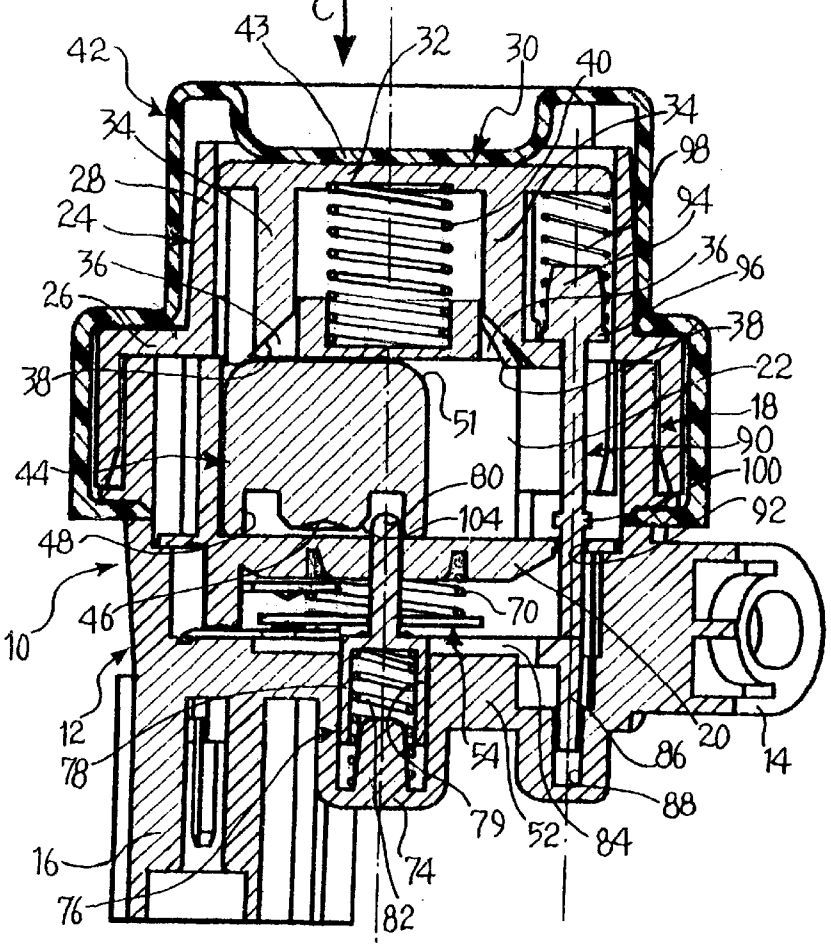
FIGS. 5 to 9 are sections in a diametral plane at 45° with respect to the plane III, in which FIG. 5 corresponds to the second state of the circuit of FIG. 4, and FIGS. 6 to 9 show four successive stages of restoration of the first state of the circuit of FIG. 3.

In FIGS. 5 and 6, as already said, the inertial mass 44 is moved to one side (in any direction) and the electrical connection between the first fixed contact 58 and the second fixed contact 66 is broken, while the possible electrical contact between the first fixed contact 58 and the third fixed contact 68 is established.

Pressure on the push button 30 in the direction of the arrow C of FIG. 6 has initially the effect that the thrust stem 90 descends which, by pressing on the projection 84, causes the push rod 76 to descend, against the force of its opposing spring 82, to a partially withdrawn position in which it has been brought to the level of the bevel 104 of the annular groove 48.

At this point, the inertial mass 44 is still engaged in the groove 48 and the projections 34 of the push button 30 are just about to engage the peripheral edge 51 of the inertial mass 44.

The spring 98, being more rigid than the spring 82, is not substantially deformed by the passage from the condition of FIG. 5 to that of FIG. 6.

Figure 7:
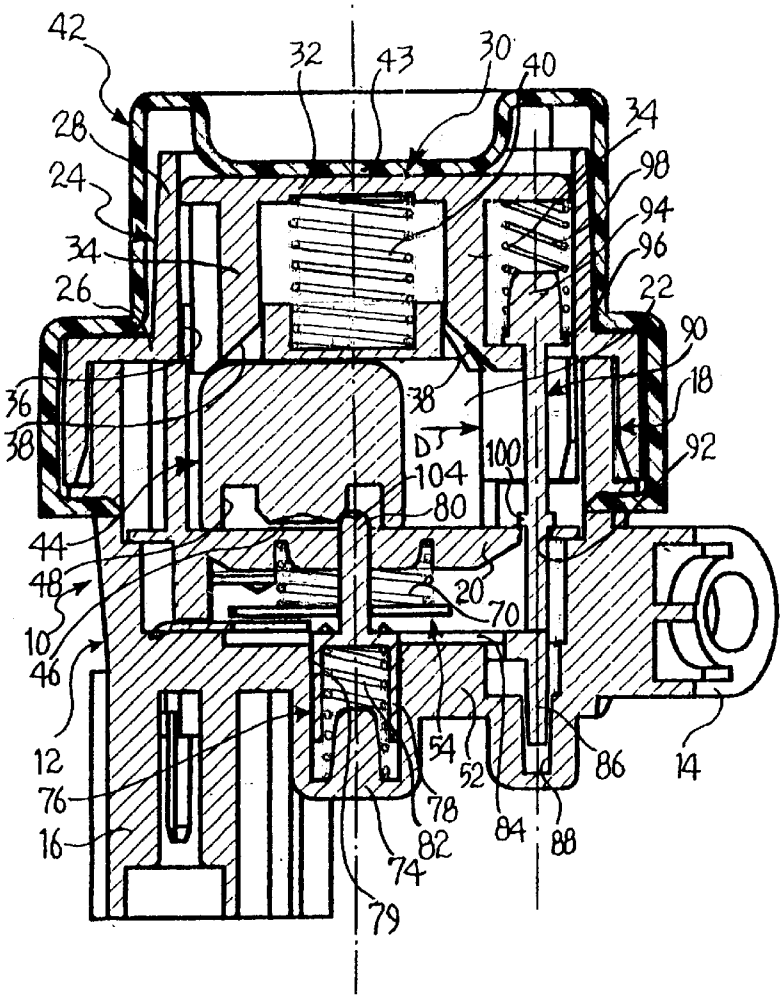

In the condition of FIG. 7, the stem 90 has come to an end stop, because the shoulder collar 100 has come into abutment on the bottom wall 20.

Further pressure on the push button 30 causes it to descend (FIG. 7) until at least one of the inclined surfaces 38 engages, with a cam action, the peripheral edge 51 of the inertial mass 44 and moves the latter in a centripetal direction, as indicated by the arrow D in FIG. 7.

This centripetal movement of the mass 44 results in the engagement of the bevel 104 with the upper end of the push rod 76 (FIG. 7).

The, cam action which ensues produces a further descent of the push rod 76, against the force of its opposing spring 82.

During this further descent of the push rod 76, the thrust stem 90 can no longer descend because its collar 100 is in abutment on base wall, but the push button 30 can continue its descent thanks to the yielding of the spring 98.

Figure 8:
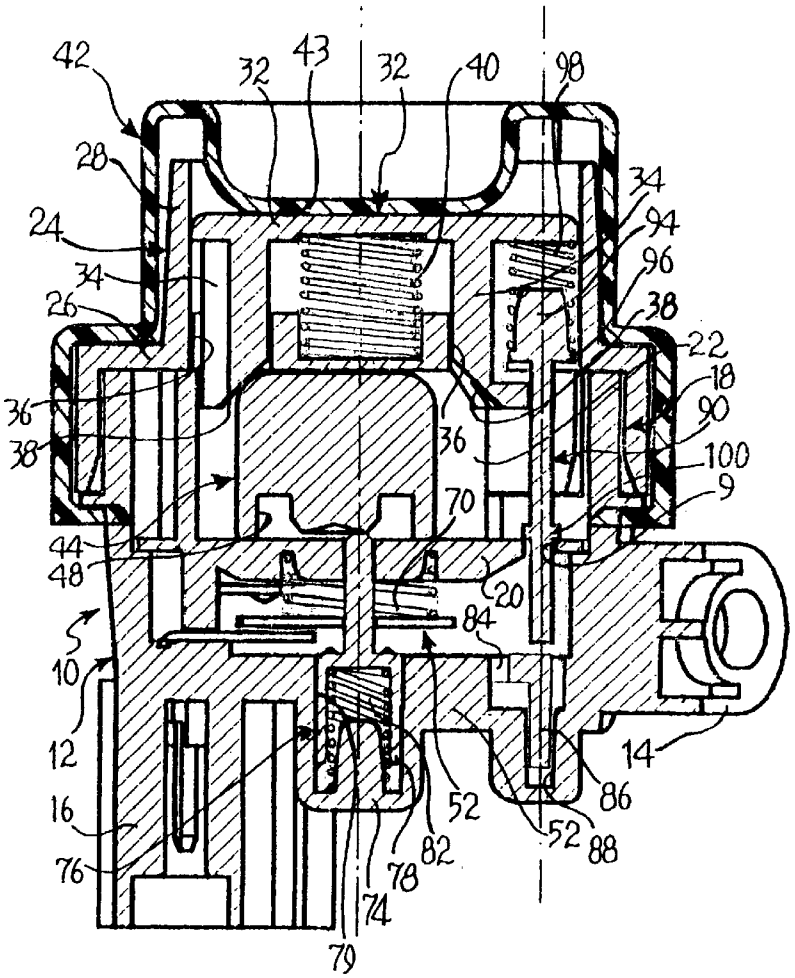

When the push button 30 continues to descend, the cam action of the bevel 104 repels the push rod 76 to a position such as to allow the annular crest 102 to pass beyond the push rod (FIG. 8).

Figure 9:
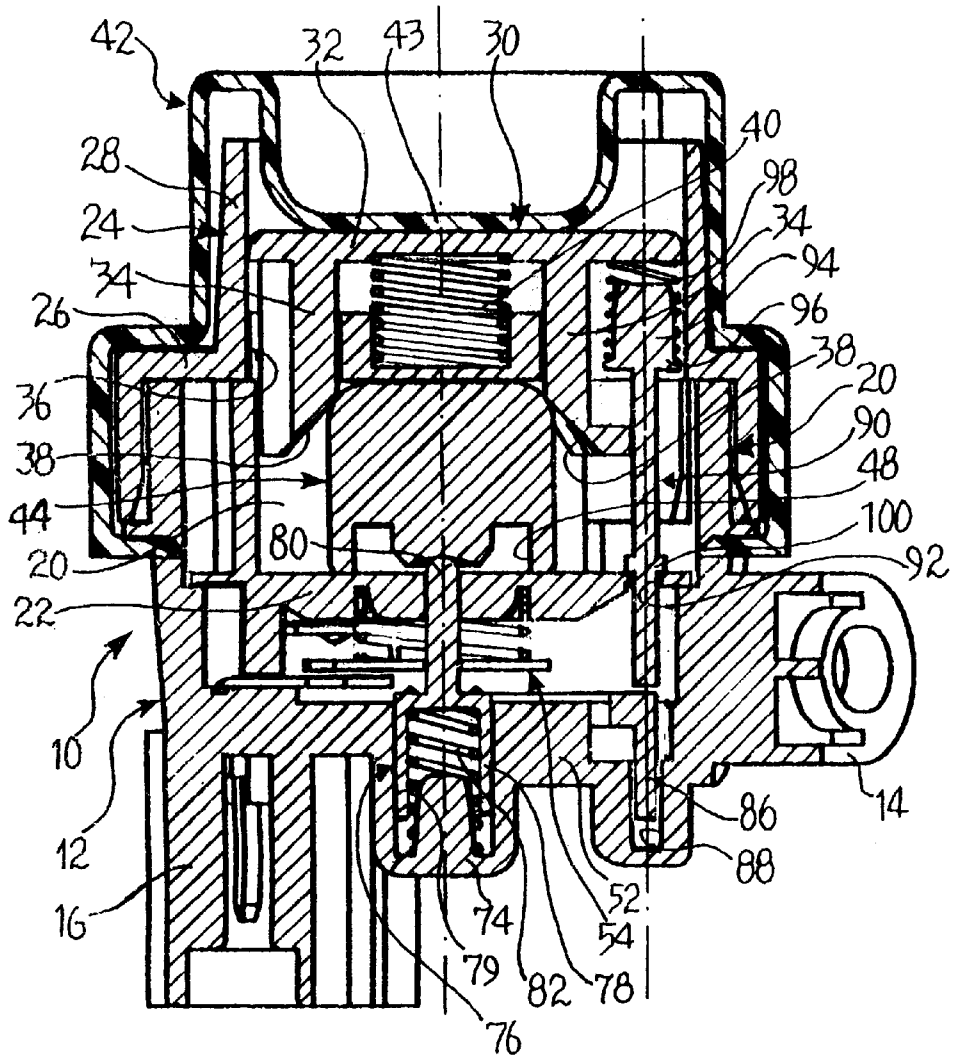

When the inertial mass 44 has finally reached the centred position due to the inclined surfaces 38 of the push button 30, as shown in FIG. 9, the push button 30 can be released and the system returns to the condition of FIG. 3, with the upper end 80 of the push rod 76 engaged in the depression 46 and with the movable contact plate 56 engaged with the fixed contacts 58 and 66.

The arrangement and the operation described with reference to FIGS. 6 to 9 have the advantage to assure that the inertial mass, once it has been deliberately brought back to the central position of FIG. 9 (and subsequently to the position of FIG. 3), does not return accidentally to the eccentric position by sliding through the effect of gravity between the base wall 20 and covering wall 26, even if the vehicle is inclined or even upside down.

This behaviour is due to the fact that the inertial mass 44, in the reset operation of FIGS. 6 to 9, is never free to radially slide outwards, but is instead obliged to move towards the center, in a first time by the engagement of the annular bevel 104 with the upper end of the push rod 76 (FIG. 7), and in a second time by the engagement of the inclined surfaces 38 with the peripheral edge 51.

The Applicant and his Assignee have come to the solution described and shown after several experimental attempts. In one of these attempts an annular groove, such as that indicated 48 in the figures, had straight and parallel sides throughout its depth and, in a reset operation, the upper end of a push rod, such as that indicated 76, was completely withdrawn from a cavity such as that indicated 22, under the action of a thrust stem such as that indicated 90.

Such experimental solution has proved to be undesirable, because the inertial mass, when the vehicle was not level (and therefore the base wall and the covering wall, facing each other, were not horizontal) slid away from the centered position as soon as the push button was released once a condition similar to that of FIG. 9 had been reached.

This drawback was due to the fact that, while the projections of the push button were moving away from the inertial mass, the push rod was still kept disengaged from the central depression of the eccentric mass by the force of a spring such as that indicated 98 in FIGS. 1 and 5 to 9.

With the solution according to the invention this drawback does not take place any more for the fact that the push button 30 is not capable to cause the descent of the push rod 78 below the partially withdrawn position. The descent of the push rod 76 beyond this position, in fact, is not produced by the thrust stem 90 or by equivalent disengagement means, and is instead produced by a cam action which is exerted by the inertial mass 44 on the push rod 76 via the annular bevel 104.

What is claimed is:

1. A safety switch intended to be fitted in an electrical circuit of a motor vehicle, said switch comprising:

a hollow body for fixing to the motor vehicle and having a cavity with a transverse base wall and a transverse covering wall;

an inertial mass in the form of a body of revolution capable of moving radially between the base wall and the covering wall, between a centred position and an infinite number of eccentric positions;

a system of electrical contacts situated to a side of the base wall remote from the cavity and comprising a movable contact member capable of establishing first and second circuit states of the switch;

a push rod associated with the movable contact member and extending centrally through the base wall to engage the inertial mass;

opposing resilient means which tend to urge the movable contact member and the push rod to the position corresponding to the second state of the circuit;

the arrangement being such that when the inertial mass is in the centred position, it retains the push rod held against the force of its opposing resilient means and enables the movable contact member to stay in the first state of the circuit, while when the inertial mass has moved to an eccentric position, the push rod is free to move under the force of its resilient opposing means, moving the movable contact member to the position corresponding to the second state; and a reset push button, accessible from the outside of the switch, which faces the covering wall outside the cavity, and which comprises a plurality of projections extending towards the base wall through the covering wall and having inclined active surfaces, which diverge towards the base wall; and resilient biasing means which urge the reset push button to a rest position in which it is remote from the covering wall;

the arrangement being such that when the push button is in the rest position, its projections do not engage the inertial mass, while when the inertial mass is in an eccentric position and the push button is pressed against the force of its resilient biasing means, the projections engage the inertial mass with a cam action and move it to the centred position, wherein the inertial mass is in the form of a body of revolution about an axis at right angles to the base wall and the covering wall, and has a flat base surface engaged with the aforesaid base wall and a flat head surface having a peripheral edge which is engagable with a cam action by the projections of the push button, the base surface has a central depression shaped substantially as a flattened cone for housing the push rod and for maintaining the push rod in the position corresponding to the first state of the circuit, and an annular groove concentric with the depression into which, when the inertial mass is in an eccentric position, the push rod enters to reach a position corresponding to the second state of the circuit, the central depression and the annular groove being separated from each other by a crest;

the annular groove is bounded by a radially inner annular side which has an annular bevel adjacent to the said annular crest to constitute a ramp adapted to cooperate in the manner of a cam with an end of the push rod against the force of its opposing resilient means to repel the push rod to a position such as to allow the annular crest to pass beyond said push rod when the mass is being brought back to the central position and to allow the push rod to enter the central depression; and disengagement means are provided, which interconnect the push button and the push rod in an arrangement such that, when the internal mass is in an eccentric position with the end of the push rod inserted in the annular groove, a pressure on the push button moves, in a first time, the push rod to a partially withdrawn position in which, when the projections of the push button engage the inertial mass to move the latter to the centered position, the said annular bevel repels the push rod, in a second time, allowing the annular crest to pass beyond the latter.

2. A safety switch as claimed in claim 1, wherein the push rod is provided with a lateral projection fixed thereto, and the means interconnecting the push button and the push rod comprise at least one thrust stem which extends between the push button and the projection outside the cavity, in that the thrust stem is adapted to reach, when the push button is being pressed, an end position such that the push rod is moved to the said partially withdrawn position, and in that a compression spring is interposed between the push button and the thrust stem and is arranged to allow the push button to continue its movement when the thrust stem has reached the end position, in order to allow the projections of the push button to bring back the inertial mass to the centered position.

3. A safety switch as claimed in claim 1, wherein the aforesaid movable contact member is in the form of a plate which extends diametrically across the body, is associated with an end of a first fixed contact and, in the aforesaid first state of the circuit, cooperates at its end with a second fixed contact, the plate being traversed freely by the push rod, and wherein resilient means are interposed between the base wall of the cavity and the plate for returning the plate to the position corresponding to the first state of the circuit against the force of the aforesaid opposing means.

4. A safety switch as claimed in claim 2, wherein the aforesaid movable contact member is in the form of a plate which extends diametrically across the body, is associated with an end of a first fixed contact and, in the aforesaid first state of the circuit, cooperates at its end with a second fixed contact, the late being traversed freely by the push rod, and wherein resilient means are interposed between the base wall of the cavity and the plate for returning the plate to the position corresponding to the first state of the circuit against the force of the aforesaid opposing means.

* * * * *

UNITED STATES PATENT AND TRADEMARK OFFICE

CERTIFICATE OF CORRECTION

PATENT NO. : 6,166,339
DATED : December 26, 2000
INVENTOR(S) : Bechis, Giovanni

It is certified that error appears in the above-identified patent and that said Letters Patent is hereby corrected as shown below:

Title page,
Insert Item -- [63] Foreign Application Priority Data
October 8, 1998 Italy ……...T098A000847 --.

Signed and Sealed this

Fifth Day of April, 2005

JON W. DUDAS
*Director of the United States Patent and Trademark Office*